United States Patent [19]

Marx et al.

[11] 4,404,750

[45] Sep. 20, 1983

[54] NEEDLEPOINT SHEET

[76] Inventors: Michael K. Marx, 905 Mt. Hood Dr., Pittsburgh, Pa. 15239; Louis P. Musante, 45 Maple Dr., Fairview, Pa. 16415

[21] Appl. No.: 242,637

[22] Filed: Mar. 11, 1981

[51] Int. Cl.[3] ..... D03D 29/00

[52] U.S. Cl. ..... 33/1 B; 112/439; 428/134; 434/95

[58] Field of Search ..... 33/1 B, 11, 12, 13; 28/149, 151; 112/401, 402, 410, 415, 416, 439; 139/29, 34; 434/95; 428/131, 134, 135

[56] References Cited

U.S. PATENT DOCUMENTS

| | | | |
|---|---|---|---|
| 1,814,260 | 7/1931 | Perugia | 112/439 |
| 1,827,614 | 10/1931 | Riviere | 112/410 |
| 3,802,144 | 4/1974 | Spica | 428/131 |
| 3,847,717 | 11/1974 | Kass | 28/149 |
| 4,044,437 | 8/1977 | Ebenstein | 28/151 |
| 4,062,995 | 12/1977 | Korpman | 428/134 |
| 4,090,300 | 5/1978 | Massucci et al. | 33/17 R |
| 4,310,313 | 1/1982 | Brundige | 434/95 |

FOREIGN PATENT DOCUMENTS

| | | | |
|---|---|---|---|
| 873002 | 4/1953 | Fed. Rep. of Germany | 434/95 |
| 348401 | 5/1937 | Italy | 28/149 |

*Primary Examiner*—Richard R. Stearns

*Attorney, Agent, or Firm*—Carothers & Carothers

[57] ABSTRACT

A needlepoint sheet of flexible plastic material having a plurality of aligned rows of perforations for receiving thread-like material such as yarn therethrough. The sheet has at least one flat face which has pattern indicia imprinted directly on the flat face so that one may needlepoint a design in accordance with the pattern indicia or in accordance with instructions utilized in combination with the pattern indicia. The pattern indicia may take on the form of a pattern needlepoint design on the flat surface of the needlepoint sheet or it may consist of indicia on the border of the flat face at spaced intervals to assist one in locating specific perforations in the sheet for sewing a needlepoint design thereon. The side walls of each of the perforations are preferably in the form of a pyramid frustrum.

5 Claims, 2 Drawing Figures

NEEDLEPOINT SHEET

BACKGROUND OF THE INVENTION

This invention relates generally to the art of needlepoint craft, and more particularly to flexible needlepoint sheets used in the craft of needlepoint.

Needlepoint sheets of flexible plastic material which have a plurality of aligned rows of perforations are commony available on the market for those interested in the craft of needlepont. Thread-like material such as yarn is sewn onto the mat or sheet through the perforations in a particular pattern which is predetermined by the needlepoint artist. However, these needlepoint sheets have shortcomings in that the plastic webbing or threads between and defining the many perforations in the sheets are rounded. Thus, when the yarn is sewn to the sheet, it conforms to the rounded surface thereof and accordingly produces a lumpy appearance. In addition, it becomes very difficult to follow designs from a separate pattern sheet supplied with the needlepont kit or from one's own separate design due to the fact that it is difficult to locate the correct perforations in the sheet with each needlepoint stitch in order to conform with the design desired, due to the fact that there are hundreds of small peforations on each sheet.

Additionally, the sheets are usually cut up into smaller sections to make small ornaments, and when this is done, it is rather difficult to measure out the small cut-out segments on the larger sheets before cutting the smaller segments therefrom, as these segments must either be measured off or the number of perforations counted in order to obtain desired needlepoint sheet segments of equal dimension, which is extremely time consuming and tedious.

In addition, if the needlepoint sheet is cut up on diagonals, a difficulty arises in that there is not enough plastic webbing or plastic thread between perforations when so cut such that the perforations may break through at the cut, leaving the perforation open at the line of cut. Yet, if the perforations are made smaller or the webbing or plastic thread between perforations is made bigger or wider in order to avoid this problem, then undesirable effects are created in that the number of perforations per square inch or surface area becomes too small, and the resulting designs created thereon by needlepoint take on an overly jagged and less uniform appearance.

It is a principal object of the present invention to provide a needlepoint sheet which is devoid of the above-identified disadvantages.

SUMMARY OF THE INVENTION

The needlepoint sheet of the present invention is of flexible plastic material, and like those of the prior art, is provided with a plurality of aligned rows of perforations therein for receiving thread-like material therethrough. However, the needlepoint sheet of the present invention is provided with at least one, and preferably two, flat faces. Thus, when a needlepoint design is created thereon with thread-like material such as yarn, the resultant sewn needlepoint design has an overall flat and pleasing appearance. In other words, the yarn covers the sheet better because the surface is flat and this provides a flat appealing texture to the needlepoint product when finished.

In addition, needlepoint pattern indicia is imprinted directly onto the needlepoint sheet on one of the flat faces. This needlepoint pattern indicia may be in the form of a pattern design imprinted directly on an interior portion of the sheet face or, additionally or separately, it may take on the form of indicia such as letter or number indicia on the border of one of these flat faces of the needlepoint sheet at spaced periodic intervals to assist one in locating specific ones of the needlepoint perforations, which was heretofore a very tedious, time-consuming and frustrating task. Also, it was never previously considered that pattern indicia should be directly imprinted on such plastic sheets of polyethylene or polypropylene, and in addition, would not have been considered to be possible on the needlepoint sheets of the prior art.

The pattern indicia may either be printed directly onto the sheet or mat or by designing the sheet molds so that the indicia is directly molded as an integral part of the needlepoint sheet.

In addition, the side walls of each of the needlepoint perforations are preferably molded to form a pyramid frustrum. The unexpected results accomplished as a result of this are multiple.

Due to the pyramid frustrum shape of the perforations, the plastic thread or webbing between perforations on one side of the needlepoint sheet are going to be wider than on the opposite side of the sheet. This accordingly adds overall strength to the sheet even though the perforations are smaller and placed closer together, and in addition, unlike the sheets of the prior art, if the sheet is cut up so that the sheet is cut on the diagonal (as opposed to vertical or horizontal) between perforations, the perforations will not break through the remaining webbing at the line of severance due to the strengthening of the plastic thread or webbing between perforations created by the pyramid frustrum shape of the perforations. This widens and strengthens the webbing between perforations on the side of the sheet wherein the webbing between perforations is wider.

This pyramid frustrum shape of the perforations, as previously explained, also provides more surface area or wider surface webbing or plastic thread between perforations on one side of the sheet as opposed to the other side of the sheet, and thus the side of the sheet which has more flat surface area due to this configuration provides an ideal surface which is large enough to imprint design indicia directly onto the plastic sheet while not sacrificing the fine mesh characteristics of the sheet.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DETAILED DESCRIPTION OF THE DRAWINGS

Referring to the figures, the needlepoint sheet 10 of the present invention consists of a flexible plastic material having a plurality of aligned rows of perforations 11 therein for receiving thread-like material (not shown) such as yarn therethrough in order to sew needlepoint designs onto the plastic mat or sheet 10. The sheet 10 is molded of any suitable plastic such as polyethylene or polypropylene, and of course, the plastic may be molded in any desired color.

Figure 1:
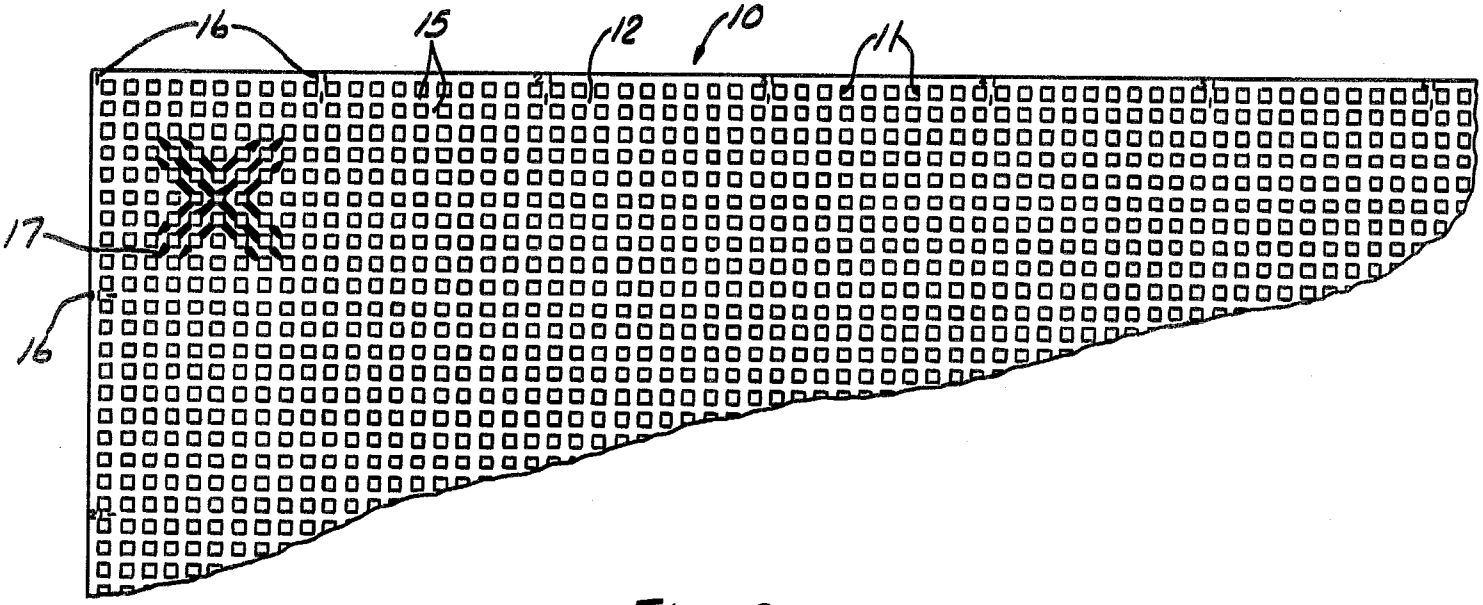
FIG. 1 is a plan view of a sectioned portion of the needlepoint sheet of the present invention with example pattern indicia printed thereon.
Figure 2:
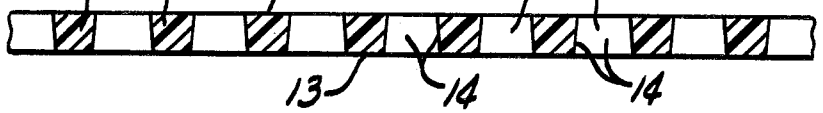
FIG. 2 is an enlarged cross-sectional view through a row of perforations of the sheet illustrated in FIG. 1 illustrating the pyramid frustrum configuration of the side walls of the needlepoint perforations.

As may be seen in the figures, both the upper face 12 and the bottom face 13 of the sheet 10 are flat. In addition, as best illustrated in FIG. 2, the side walls 14 of each of the perforations 11 are in the form of a pyramid frustrum. The result is, as previously explained, that there is more flat surface area on the upper face 12 of the sheet than on the bottom face 13 due to the fact of this pyramid frustrum shape of the perforations 11, which creates plastic webs or threads 15 between and defining perforations 11 which are wider in surface area on the upper face 12 than on the bottom face 13. This permits a fine mesh, which in this illustration is about 6½ perforations per inch, or greater, while providing a needlepoint sheet which is nevertheless even stronger than those of the prior art. Additionally, the flat faces of the sheet 10 provide a desirable smooth or silky feeling to the overall finish of the needlepoint sheet.

The top surface 12 of the sheet is considered and used as the top side, as this is the surface with the greater surface area. This also permits the printing of pattern indicia directly onto the flat face 12 with ease, such as in the form of the borderline indicia 16 or the pattern design indicia 17. Both the borderline indicia 16 and the pattern design indicia 17 are generally referred to herein as needlepoint pattern indicia which is imprinted on the flat face 12 of the needlepoint sheet 10.

The borderline indicia 16 here is molded integrally with the mat as raised indicia, and it is applied with ink after molding to make it stand out. To the contrary, the pattern design indicia 17 is directly imprinted onto the molded mat or sheet surface 12.

The indicia 16 on the borderline of flat face 12 is spaced at periodic intervals after each tenth perforation to assist one in locating specific ones of the perforations 11 internally from the border edges of the sheet when doing a needlepoint design. Also, this indicia 16 can be very useful for location of cutting lines for cutting the sheet up into smaller segments in order to make small ornaments.

The imprinted pattern design indicia 17 is here illustrated in the form of arrows indicating to the one crafting the needlepoint design how the needlepoint stitching should be made, indicating through which perforations 11 the yarn should be drawn up, and through which perforations 11 the yarn should be passed back down to create the resultant design. Of course, this needlepoint design indicia 17 may take on different forms other than arrows, such as solid squares, open squares, dots, circles, etc., and imprinting of different colors in order to indicate how the design is to be formed and to indicate the color of yarn to be utilized for the particular design in that segment of the needlepoint sheet.

We claim:

1. A needlepoint sheet of flexible plastic material having a plurality of aligned rows of perforations therein for receiving thread-like material therethrough, at least one face of said sheet being flat, said perforations having side walls in the form of a pyramid frustrum.

2. The needlepoint sheet of claim 1, including indicia on the border of said flat face at spaced periodic intervals to assist one in locating specific ones of said perforations.

3. The needlepoint sheet of claim 2, wherein said indicia is molded integrally with the sheet.

4. A needlepoint sheet of flexible plastic material having a plurality of aligned rows of perforations therein for receiving thread-like material therethrough, the improvement comprising said sheet having flat faces on both sides thereof, and wherein the side walls of said perforations form a pyramid frustrum.

5. The needlepoint sheet of claim 4, including needlepoint pattern indicia imprinted on at least one of said flat faces.

* * * * *